United States Patent [19]

Blockinger

[11] Patent Number: 4,878,314

[45] Date of Patent: Nov. 7, 1989

[54] HIGH SECURITY WINDOW

[76] Inventor: Larry A. Blockinger, 7416 Wonder La., Jacksonville, Fla. 32244

[21] Appl. No.: 253,752

[22] Filed: Oct. 5, 1988

[51] Int. Cl.[4] ..... E06B 5/10

[52] U.S. Cl. ..... 49/381; 49/394; 109/49.5; 109/79; 52/789

[58] Field of Search ..... 52/789, 202, 222, 171, 52/589; 49/381, 394, 395; 160/380, 399, 403; 109/49.5, 79

[56] References Cited

U.S. PATENT DOCUMENTS

| | | | |
|---|---|---|---|
| 2,093,727 | 9/1937 | Julien | 49/62 |
| 2,393,350 | 1/1946 | Wiedman . | |
| 2,877,516 | 3/1959 | Bobel | 52/789 X |
| 2,915,793 | 12/1959 | Berg | 52/789 X |
| 2,976,583 | 3/1961 | McCarthy | 52/789 X |
| 3,696,857 | 10/1972 | LeTarte | 160/403 X |
| 3,745,938 | 7/1973 | Nathaway et al. . | |
| 3,855,898 | 12/1974 | McDonald . | |
| 3,866,242 | 2/1975 | Slagel . | |
| 4,030,258 | 6/1977 | Anders . | |
| 4,428,154 | 1/1984 | Rinehart | 49/394 X |
| 4,562,666 | 1/1986 | Young, III | 49/62 |
| 4,562,668 | 1/1986 | Karhu et al. | 49/381 |
| 4,567,100 | 1/1986 | Pickett et al. . | |
| 4,625,659 | 12/1986 | Saelzer . | |
| 4,662,289 | 5/1987 | Harder . | |

*Primary Examiner*—David A. Scherbel
*Assistant Examiner*—Lan Mai
*Attorney, Agent, or Firm*—Fishman, Dionne & Cantor

[57] ABSTRACT

A high security window is presented with a bullet resistant window pane on the exterior, an optional standard window pane on the interior, and an explosion resistant screen centrally located between the panes. The screen is electrically charged to prevent intruders from entering through the window. The window effectively protects against terrorists attacks, yet has pleasing aesthetics. The window can be opened and closed for both safety and security.

9 Claims, 2 Drawing Sheets

HIGH SECURITY WINDOW

BACKGROUND OF THE INVENTION

The present invention relates to a high security window. More specifically the present invention relates to a bullet resistant, explosion proof and intruder resistant window, in which heavy gauge stainless steel screen is electrically charged and is spaced from and parallel to a bullet resistant glass or plastic pane.

Since the advent of a televised global media, terrorism has been on the rise. A global media provides an avenue for terrorists to express themselves and their beliefs internationally. To attain media coverage, the terrorists will commit an act of terrorism which will be televised depicting the act of terrorism and expressing the views of the terrorists.

The terrorist act will be heinous and/or it will affect a person or persons worthy of extended media coverage. When and where an act of terrorism will occur is difficult for governments, let alone individuals to predict. Many terrorists are supported by wealthy entities so they are well trained and well armed, thus making security against terrorist acts expensive and often ineffective. The best defense against terrorism may be the creation of a fortress within an individuals home.

One security window discussed in U.S. Pat. No. 2,393,350 to Wiedman offers explosion, bullet, and intruder resistance, at the expense of aesthetics and a blocked view. The Wiedman window uses a series of rotatably mounted vertical steel bars, strategically placed in conjunction with a bullet resistant glass pane to prevent low and high caliber projectiles from passing through the window. The bars block the windows view and create a cold inhibiting atmosphere in the room in which the window is placed.

Another prior art device used as a security window frame is shown in U.S. Pat. No. 4,625,659 to Saelzer. The Saelzer device discloses a bullet resistant vent for a window frame or door frame. The vent has two bullet resistant plates internally located within the frame. The plates are spaced parallel to each other, and one plate backs the vent opening.

U.S. Pat. No. 4,030,258 to Anders describes a means for securing a bullet resistant bank window, without having fasteners located on the exterior side of the window. The window described in Anders is not explosion resistant.

Despite the presence of these known security windows, each suffers from certain drawbacks and disadvantages. Accordingly, there continues to be a need for improved security windows, doors and the like.

SUMMARY OF THE INVENTION

The above discussed problems and other disadvantages of the prior art are overcome by the terrorist proof window of the present invention. In accordance with the present invention, the window utilizes both a heavy gauge (minimum #47 gauge titanium or stainless steel) screen and a bullet resistant glass or plastic window pane to prevent the intrusion of bullets and explosives. It will be appreciated that the heavy gauge screen will prevent the force of an explosion from destroying the window. The window is internally secured by locks which can only be opened with a key. The window is hinged so it may be opened. The hinges are hidden to the outside to prevent being jarred or jammed.

Preferably, the stainless steel or titanium screen used in the window of this invention is electronically wired. Any person who attempts to break in through the window will thus be electrically shocked. This feature makes the window virtually intruder proof.

The screen is attached to the window by a novel bracket. This bracket secures the window screen and prevents it from blowing out in the event of an explosion. The bracket also retains and supports the screen during assembly.

The use of a stainless steel screen for explosion proofing creates a window which is aesthetically similar to a window found in a home. This is important to the individual who requires maximum security, yet does not want to feel imprisoned. Since the window of the present invention provides maximum protection from bullets, explosions and intruders and yet provides pleasant aesthetics, it is a clear improvement over the prior art.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several Figures:

FIG. 2*a* is a cross-sectional exploded view or segment 2—2 of the bracked assembly of FIG. 2*a.

DETAILED DESCRIPTION OF THE INVENTION

Figure 2A:
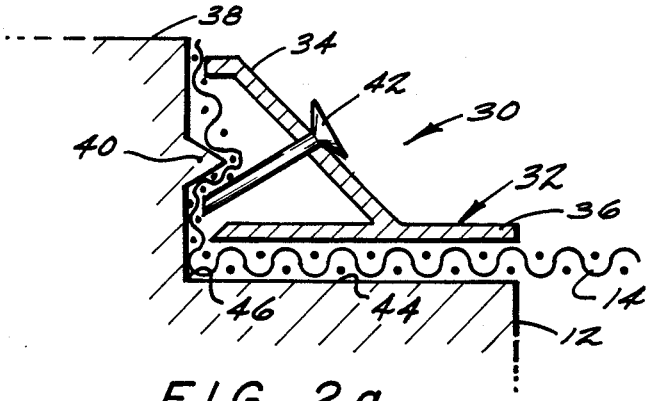
Figure 1:
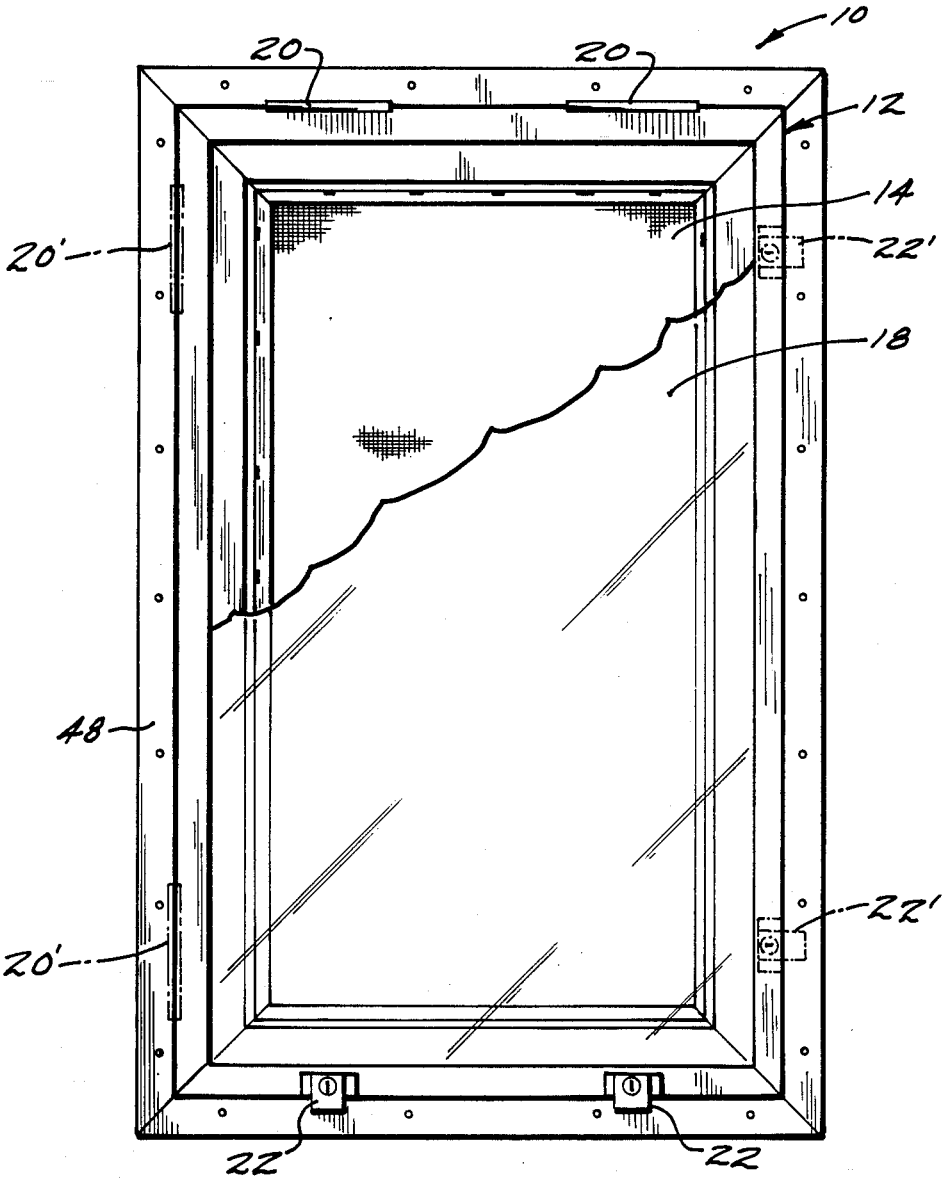
FIG. 1 is an interior elevational view of the high security window in accordance with the present invention with a cutaway which shows the stainless steel screen.
Figure 2:
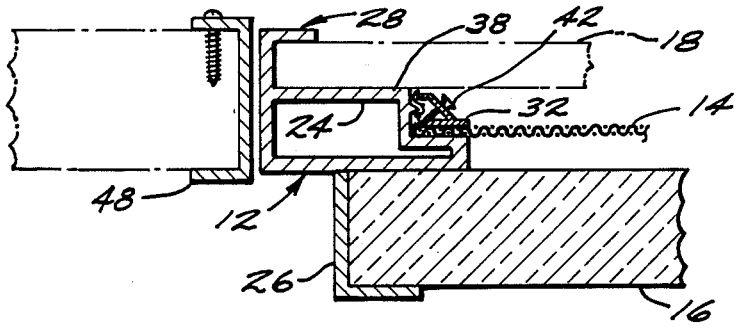
FIG. 2 is a cross-sectional view of segment 2—2 of FIG. 1 showing in detail the bracket assembly.
Figure 3:
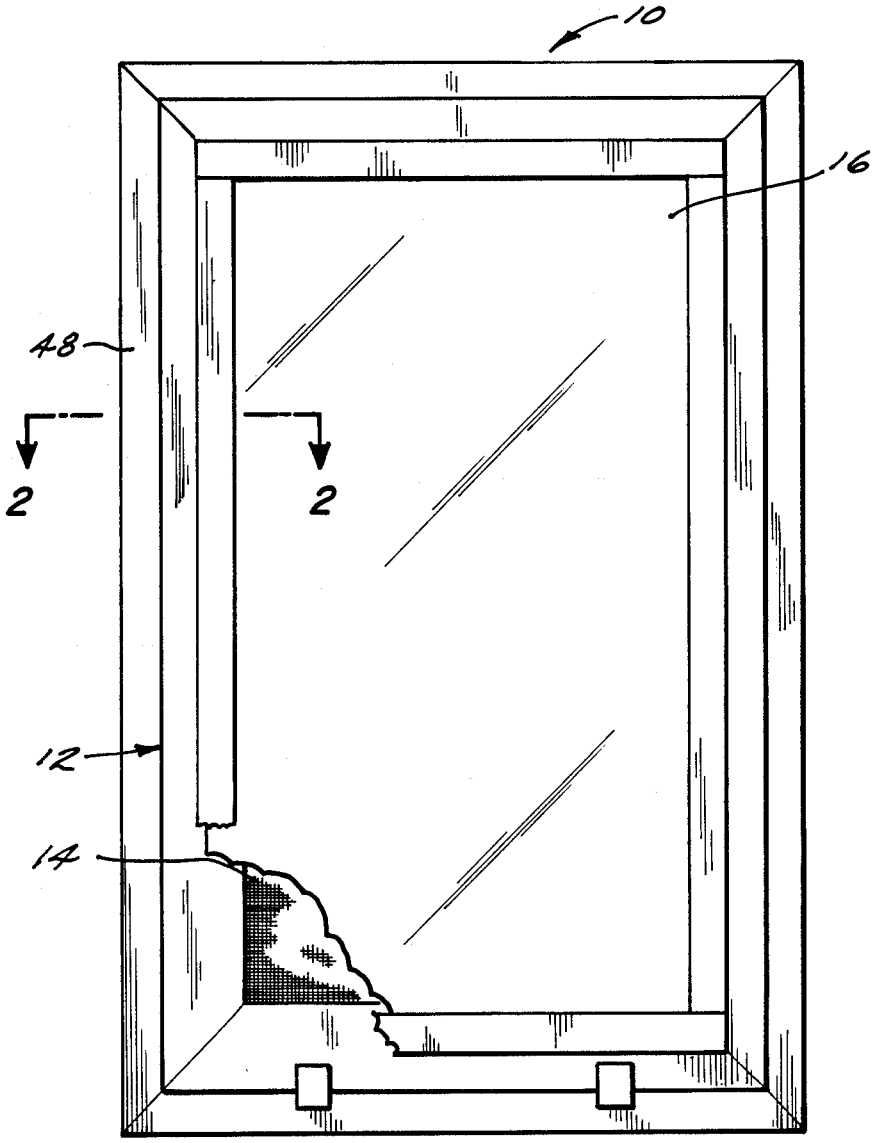
* and FIG. 3 is an exterior elevational view of the window of FIG. 1.

Referring jointly to FIGS. 1–3, a high security window is shown generally at 10. Window 10 includes a window frame 12, a heavy gauge stainless steel screen 14, a bullet resistant window pane 16, an optional standard window pane 18, hinges 20 and locks 22.

Window frame 12, shown in detail in FIGS. 2 and 2*a*, is comprised of four essential elements; the main element being a hollow tubular section 24 of rectangular construction. Hollow section 24 includes a pair of L-shaped extensions which define two channels, exterior channel 26, and interior channel 28. Each channel 26 and 28 forms a U-shape in conjunction with a wall of the tubular section 24. Hollow section 24 preferably comprises ⅛ inch thick extruded walls and has a width of 2 inches and an overall thickness of 1 inch, while those are the preferable dimensions, any thickness or width may be used.

Exterior channel 26 supports and retains bullet resistant window pane 16, and interior channel 28 supports and retains standard window pane 18. It will be appreciated that standard window pane 18 may also be bullet resistant. It will be further appreciated that the width of both channels are of sufficient size so as to hold the respective window panes. Incorporated into the design of tubular section 24 is a square notch 30. Square notch 30 is used in conjunction with a screen attachment bracket 32 to hold screen 14 to window frame 12.

Screen attachment bracket 32 is Y-shaped. The Y has two legs including a support leg 34 and a barrier leg 36.

Bracket 32 runs the full perimeter of the interior of window frame 12. Four brackets 32 are used for each window 10. Bracket 32 is positioned in notch 30, such that barrier leg 36 is located in a position parallel to screen 14. Support leg 34 angularly extends from barrier leg 36 down to a notch base 38. The space defined between support leg 34, barrier leg 36 and notch base 38 encompasses a triangular ridge 40 which extends from notch base 38 and runs the full internal perimeter of window 10. A fastening device 42, which can include screws or other mechanical fasteners, extends through support leg 34 into notch base 38. The base of fastener 42 lies on the opposite side of triangular ridge 40 to support leg 34.

Screen 14 is pinched between barrier leg 36 and the rear notch surface 44 where screen 14 extends into notch corner 46 and over triangular ridge 40. Bracket 32 holds screen 14 in corner 46 so that when fastener 42 is driven through screen 14 and into notch base 38, the screen is tightly held into place. Fasteners 40 are located about every 2 inches along support leg 34. It will be appreciated that this arrangement secures screen 14 to frame 12 with force sufficient to withstand on explosion. It will be further appreciated that fasteners 42 can be spaced more or less than 2 inches apart depending on security needs.

Upon assembly of window 10, frame 12 is connected to a window sash 48 by a pair of hinges 20 and locks 22. Sash 48 preferably has a 1¼ inch thickness and is made of one eighth inch extruded aluminum. Sash 48 has mitered 45° joints which are welded and sanded smooth. The hinges can be located on either the vertical (see hinges 22') or horizontal (see hinges 22) edges of the window 10 with the locks being opposed on the other vertical (locks 22') or horizontal (locks 22) window edge. Hinges 20 are concealed from the exterior for security reasons. Hinges 20 are preferably 3¾ inches long. Locks 22 secure frame 12 to sash 48. The locks are key opened from the interior 10. Window 10 can be opened either manually or electronically for safety and convenience.

Screen 14 is of heavy gauge (minimum #47) high tensile stainless steel or titanium wire mesh, preferably dutch weave and 10—10 mesh).

When secured with bracket 32, screen 14 protects against explosions. Screen 14 is centrally located between bullet resistant window pane 16, and optional standard window pane 18. Bullet resistant window pane 16 is located on the exterior side of window 10.

Bullet resistant pane 16 is a minimum of one inch thick. Pane 16 sits in channel 26 of frame 12. Pane 16 is made of either bullet resistant glass or plastic. Pane 16 prevents bullets and small projectiles from passing through window 10. Pane 16 will also prevent intruders from smashing through window 10.

Standard window pane 18 is optional and is interiorly located. Standard window pane 18 can be either glass, plastic, or of a bullet resistant material. Pane 18 fits into and is retained by channel 28 of frame 12.

The window 10 of the present invention provides maximum security at a minimum loss in aesthetic appeal. Window 10 is bullet resistant, explosion proof and intruder proof. It effectively protects against unwanted intruders such as terrorists. It will be appreciated that the present invention may also be used as a door or other opening and is not intended to be limited to a "window".

While preferred embodiments have been shown and described various modifications and substitutions may be made thereto without departing from the spirit and scope of the invention. Accordingly it is to be understood that the present invention has been described by way of illustrations and not limitations.

What is claimed is:

1. A security window including:

a bullet and explosion resistant exterior optically clear window pane;

a steel or titanium screen spaced from and parallel to said pane;

frame means for securing and retaining said screen and said pane; and sash means, said frame means being pivotably mounted in said sash means.

2. The window of claim 1 which further includes:

an interior optically clear pane, said screen being sandwiched between said bullet resistant exterior pane and said interior pane.

3. The window of claim 2 wherein:

said interior window pane is comprised of a bullet resistant material.

4. The window of claim 1 including:

bracket means for mounting said screen to said frame means.

5. The window of claim 4 wherein said bracket means comprises:

a barrier leg which holds said screen against said frame;

a support leg which braces said barrier leg against said frame; and fastening means for mechanically fastening said bracket to said frame.

6. The window of claim 5 wherein:

said barrier leg and support leg define a Y-shape.

7. The window of claim 1 including:

hinge means pivotably connecting said frame means to said sash, said hinge means allows said window to be opened either manually or electronically.

8. The window of claim 1 including:

lock means for locking said frame means to said sash means.

9. The window of claim 7 including:

lock means for locking said frame means to said sash means.

* * * * *